United States Patent [19]

Browning

[11] 4,426,258

[45] Jan. 17, 1984

[54] DRYING WOOD PULP IN THE PRESENCE OF AN ALKALI METAL SULPHITE

[75] Inventor: Thomas Browning, Nuneaton, England

[73] Assignee: Courtaulds Limited, London, England

[21] Appl. No.: 353,814

[22] Filed: Mar. 2, 1982

[30] Foreign Application Priority Data

Mar. 6, 1981 [GB] United Kingdom ..... 8107175

[51] Int. Cl.[3] ..... D21C 3/04; D21C 9/14; D21C 9/18; D21B 1/16

[52] U.S. Cl. ..... 162/23; 162/56; 162/84; 162/85

[58] Field of Search ..... 162/83, 84, 85, 26, 162/88, 76, 89, 19, 23, 18, 24, 56, 25, 26

[56] References Cited

U.S. PATENT DOCUMENTS

| | | | |
|---|---|---|---|
| 3,069,784 | 12/1962 | Aldred et al. | 34/13.8 |
| 3,388,037 | 6/1968 | Asplund et al. | 162/23 |
| 4,065,347 | 12/1977 | Aberg | 162/26 |
| 4,145,246 | 3/1979 | Goheen et al. | 162/83 |
| 4,207,140 | 6/1980 | Lindahl | 162/26 |
| 4,244,778 | 1/1981 | Lindahl et al. | 162/83 |

OTHER PUBLICATIONS

"Eastex Starts Up First Commercial Displacement Bleach Plant In World", Paper Trade Journal; Jun. 1, 1976.

"Thermomechanical Wood Pulp", Research Disclosure, No. 16751;3/1978.

*Primary Examiner*—Steve Alvo

*Attorney, Agent, or Firm*—Howson and Howson

[57] ABSTRACT

Bleached wood pulp is treated with a sulphite after bleaching and before or during flash drying to reduce the formation of nodules of agglomerated wood pulp fibres in the dried pulp, particularly in short fibre pulp from hard woods such as birch and eucalyptus. The sulphite is preferably added to the bleached pulp in the form of an aqueous solution of an alkali metal sulphite for example a 0.4 to 5 percent by weight solution of sodium sulphite. The process of the invention is particularly suitable for drying pulp which is at an acid pH due to residual acids remaining on the pulp from the bleaching process, for example pulp bleached by treatment with chlorine dioxide.

8 Claims, 3 Drawing Figures

DRYING WOOD PULP IN THE PRESENCE OF AN ALKALI METAL SULPHITE

This invention relates to drying wood pulp. The most important use for wood pulp is in making paper. If the wood pulp is to be transported from its place of manufacture to the paper mill it must be dry. The least expensive drying method is flash drying with hot air, for example at 200° to 600° C. This drying method has the disadvantage that nodules of agglomerated wood pulp fibres may be formed in the dried pulp, particularly in short fibre pulp from hardwoods such as birch and eucalyptus. These nodules may remain when the pulp is made into paper and mar the quality of the paper. To avoid nodule formation, short fibre pulp for paper has generally had to be dried in sheet form on apparatus similar to that used for paper making.

When unbleached kraft pulp is flash dried it is known to add sulphur dioxide gas to the drying gas in order to reduce nodule formation. However, the addition of sulphur dioxide has been found to be ineffective for drying bleached pulps. Pulp usually needs to be bleached for making into paper and since bleaching is carried out in an aqueous medium the pulp is bleached before drying.

In a process according to the invention for producing dried bleached wood pulp by drying bleached wood pulp in a flash drier the wood pulp is treated with a sulphite after bleaching and before or during the flash drying step.

The sulphite treatment reduces the tendency of the pulp to form nodules on flash drying and enables a short fibre pulp to be flash dried and still be suitable for paper making.

The wood pulp can be a chemical pulp, produced using an acid, alkaline or neutral pulping process, for example kraft sulphate or sulphite pulping, or a mechanical pulp produced by mechanical thermo-mechanical pulping. The invention is particularly applicable to short fibre pulp from hard woods such as birch and eucalyptus since these are the pulps which suffer most from nodule formation on flash drying. The process of the invention can also be applied to long fibre pulp from soft woods such as spruce and pine or to mixtures of short and long fibre pulps.

The pulp is bleached after pulping, preferably by treatment with chlorine dioxide. The process of the invention is particularly suitable for drying pulp which is at an acid pH due to residual acids remaining on the pulp from the bleaching process.

The bleached pulp is preferably compressed in a dewatering press to increase its solids content to 35 to 60 percent by weight, preferably 40 to 50 percent by weight. The dewatering press generally presses the pulp against a screen which retains the pulp fibres but allows the water to be forced through the screen, optionally with the aid of suction. For example the dewatering press can be in the form of a pair of perforated hollow rollers arranged to compress the pulp between them so that the water squeezed from the pulp passes through the perforated surface to the interior of the rollers. Alternatively the dewatering press can comprise a conveyor screw rotating within a screen.

The sulphite is preferably added in the form of an alkali metal sulphite, most preferably sodium sulphite but potassium and ammonium sulphites are alternatives. It is preferably added to the pulp before the solids content of the pulp is increased in the dewatering or during the dewatering treatment. In one procedure water is added to the bleached pulp to form it into a slurry for feeding the dewatering press. For example, the pulp may be discharged from the bleaching process at a solids content of 8 to 15 percent by weight and may be diluted to 2 to 6 percent before being fed to the dewatering press. In this case the sodium sulphite is preferably added to the water used to dilute the pulp. Alternatively, a solution of sodium sulphite can be sprayed on the pulp after bleaching and before, during or after dewatering. Sodium sulphite can be included in the final washing water used to wash the pulp after bleaching.

When the sulphite is applied to the pulp before dewatering, considerable quantities of aqueous sulphite solution are removed from the pulp during dewatering, and at least part of this solution is preferably collected so that the sulphite can be re-used or recovered. In a process where the pulp is diluted after bleaching and before the dewatering press, the sulphite solution can be recycled to dilute incoming bleached pulp. The sulphite solution can alternatively be recycled to the dewatering press.

The concentration of sulphite in the water in contact with the pulp is preferably 0.4 to 5 percent by weight, most preferably 1 to 2 percent. In a system which recycles sulphite solution sodium sulphite in solid or concentrated form can be added to the sulphite solution which is recovered from the dewatering press at a rate sufficient to maintain a substantially constant concentration of sulphite in the pulp slurry fed to the dewatering press. The amount of sulphite used is also preferably about 0.4 to 5 percent by weight based on wood pulp solids in the pulp fed to the drier; since the pulp issuing from the dewatering press usually has a solids content close to 50 percent by weight the concentration of sulphite based on water is similar to the concentration based on wood pulp solids at this stage in the process.

In an alternative method of carrying out the invention the pulp is treated with an alkali, preferably an aqueous alkali metal or ammonium hydroxide, after bleaching and before drying and the alkali is converted to a sulphite in situ on the pulp by introducing sulphur dioxide in the drying gas. For example sodium hydroxide can be added to the pulp using any of the procedures described above for adding sodium sulphite. Sulphur dioxide can be introduced in the drying gas by injecting liquid or gaseous sulphur dioxide or by burning sulphur to produce sulphur dioxide. For example a fuel having a high sulphur content can be burnt in the heater for the drier. This fuel can be oil or can be producer gas derived from coal of high sulphur content.

Drying can be carried out in any type of flash drier known for drying pulp by hot gas, usually air, at a temperature in the range 200° to 600° C. The drier can be in the form of one or more towers up which the pulp and hot gas pass or a conduit but the preferred form of drier is that described in British Pat. No. 888,845, which is a high turbulence mixer through which the pulp and hot gas are fed and which has relatively movable mechanical members which exert a shearing action on the pulp. The preferred temperature of the hot air at the inlet of such a drier where it contacts the wood pulp is 400° to 500° C. and the temperature at the outlet of the drier is preferably 90° to 150° C.

The invention will now be described with reference to the accompanying drawings.

Figure 1:
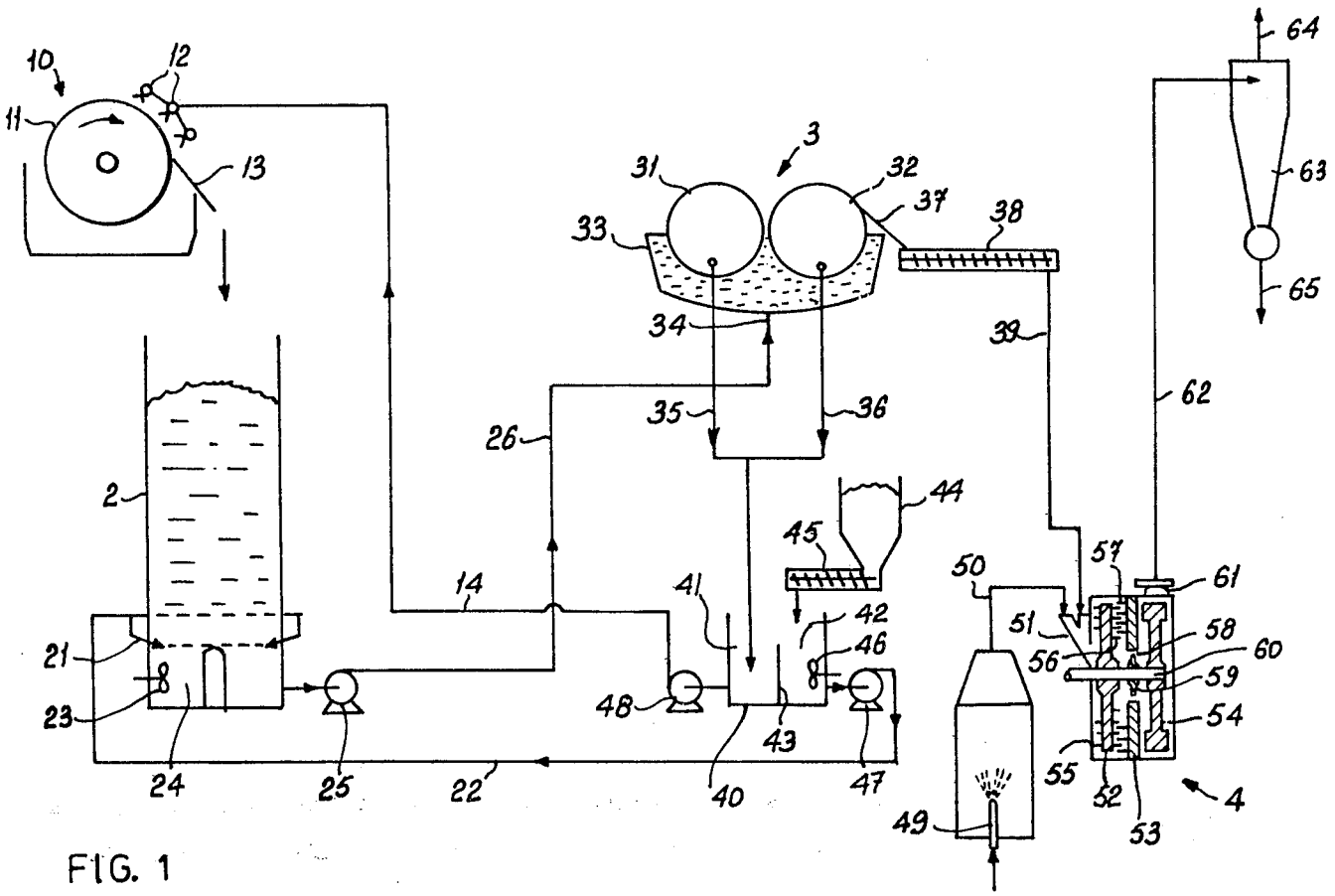
FIG. 1 is a diagrammatic side elevation partly in section of an apparatus for drying bleached wood pulp by the process according to the invention.

The apparatus of FIG. 1 generally receives pulp from the final stage of the bleaching process and comprises a stock tower 2 for holding bleached pulp, a dewatering press 3 and a drier 4.

The final stage of the bleaching process is generally a washer 10. The washer 10 comprises a perforated drum 11 which receives bleached pulp. Suction is applied from the interior of the drum to aid in removal of water. The pulp on the drum 11 is washed with water from sprays 12 and is then removed from the pulp by a doctor blade 13. The final stage of the bleaching process can alternatively be a thickening step in which the pulp solids content is increased on a perforated drum.

The moist, washed, bleached pulp from the washer 10 passes to the stock tower 2, which acts as a reservoir for bleached pulp. The bottom of the stock tower 2 has a series of inlets, such as 21, for water suppled by a pipe 22. The water continuously forms a slurry with the material at the bottom of the column of pulp. This slurry is stirred by a paddle 23 in the lower part 24 of the stock tower 2 to aid mixing of the pulp and water in the base of the tower 2 and the slurry is pumped from the tower 2 by a pump 25 through a pipe 26 to the dewatering press 3.

The dewatering press 3 comprises a pair of hollow perforated rollers 31, 32 rotating in a tank 33 having at least one inlet 34 near its base for the pulp slurry. The slurry is constrained to pass between the rollers 31, 32 which press water from the pulp through the perforated roller surfaces to their interiors. Pulp of increased solids content is removed from the rollers 31, 32 by a doctor blade 37 and passes through a breaker conveyor 38 to a duct 39 which feeds the drier 4. The dewatering press 3 has a control device (not shown) to control the flow of pulp in the system to give a substantially constant load to the drier 4.

The waste water which passes through the perforated surface to the interior of the rollers 31, 32 is removed by pipes 35, 36 to a waste water tank 40. This tank is divided into two compartments 41, 42 by a baffle 43. The waste water from the dewatering press 3 enters one compartment 41 but the baffle 43 is of such a size that the waste water can spill over into the other compartment 42. Sodium sulphite is fed to the latter compartment 42 of the tank 40 from a hopper 44 via a meter 45 and the waste water and sulphite are agitated in the tank 40 by a stirrer 46. Sulphite solution is pumped from the second compartment 42 of the tank 40 by a pump 47 to the pipe 22 whereby it is recycled to the stock tower 2 to form a slurry with the bleached pulp. Some of the sulphite added is thus returned to the tank 40 via the pipes 35, 36 but some is removed in the moisture associated with the pulp passing to the duct 39. The meter 45 controls the rate of addition of sodium sulphite to maintain a substantially constant sulphite concentration in the water contacting the pulp.

As well as feeding the inlets 21 of the stock tower 2, the sulphite solution from the tank 40 can provide all or some of the water used in the washer 12. Some of the waste water entering the compartment 41 is withdrawn by a pump 48 through a pipe 14 to the sprays 12 of the washer 10. The water thus withdrawn from the compartment 41 has a lower sulphite concentration than the water withdrawn from the compartment 42 by the pump 47 for recycle to the stock tower 2.

In an alternative to the recycle system shown in FIG. 1, the waste water withdrawn from compartment 41 can be recycled to washers in the dewatering press 3 situated below the level of the pulp slurry in the press 3. The washers are positioned to impinge on the pulp just before it passes through the nip between rollers 31, 32.

The drier 4 is of the type generally described in British Pat. No. 888,845. Hot air, for example at a temperature of 400° to 500° C., is produced in a heater 49 and is supplied to the drier through a pipe 50. The hot air contacts pulp fed to the drier 4 through the duct 39 at the inlet chute 51 of the drier.

The drier 4 is a high turbulence mixer in which the hot air and wood pulp are rapidly mixed and subjected to a shearing action and the dried wood pulp fibres formed are carried away in a stream of the hot air. The drier 4 comprises a rotary disc 52, a stationary disc 53 and an extractor fan 54. The rotary disc 52 carries on one side hammers 55 which work against the wall of the drier and on the other side pegs 56 which intermesh with pegs 57 mounted on the stationary disc 53. The wood pulp and hot air entering the drier 4 have to pass the hammers 55 which serve to break up fibre bundles and then between the pegs 56, 57 which evenly disperse the fibres in the flow of air. The air and fibres then pass through an opening 58 at the centre of stationary disc 53, which opening is controlled by rejector arms 59. Thence they are forced by the extractor fan 54, which is mounted on the same shaft 60 as disc 52, to the exit 61 of the drier 4.

A stream of air carrying dry wood fibres emerges from drier 4 through a pipe 62 which conveys it to a cyclone separator 63 which is a conical rotary separator discharging moisture laden air through a top outlet 64 and flash dried pulp through a bottom outlet 65. Part of the moisture laden air discharged at 64 is preferably recycled to the burner 49 of the drier 4 as described and claimed in British patent specification No. 2,005,394A.

Figure 2:
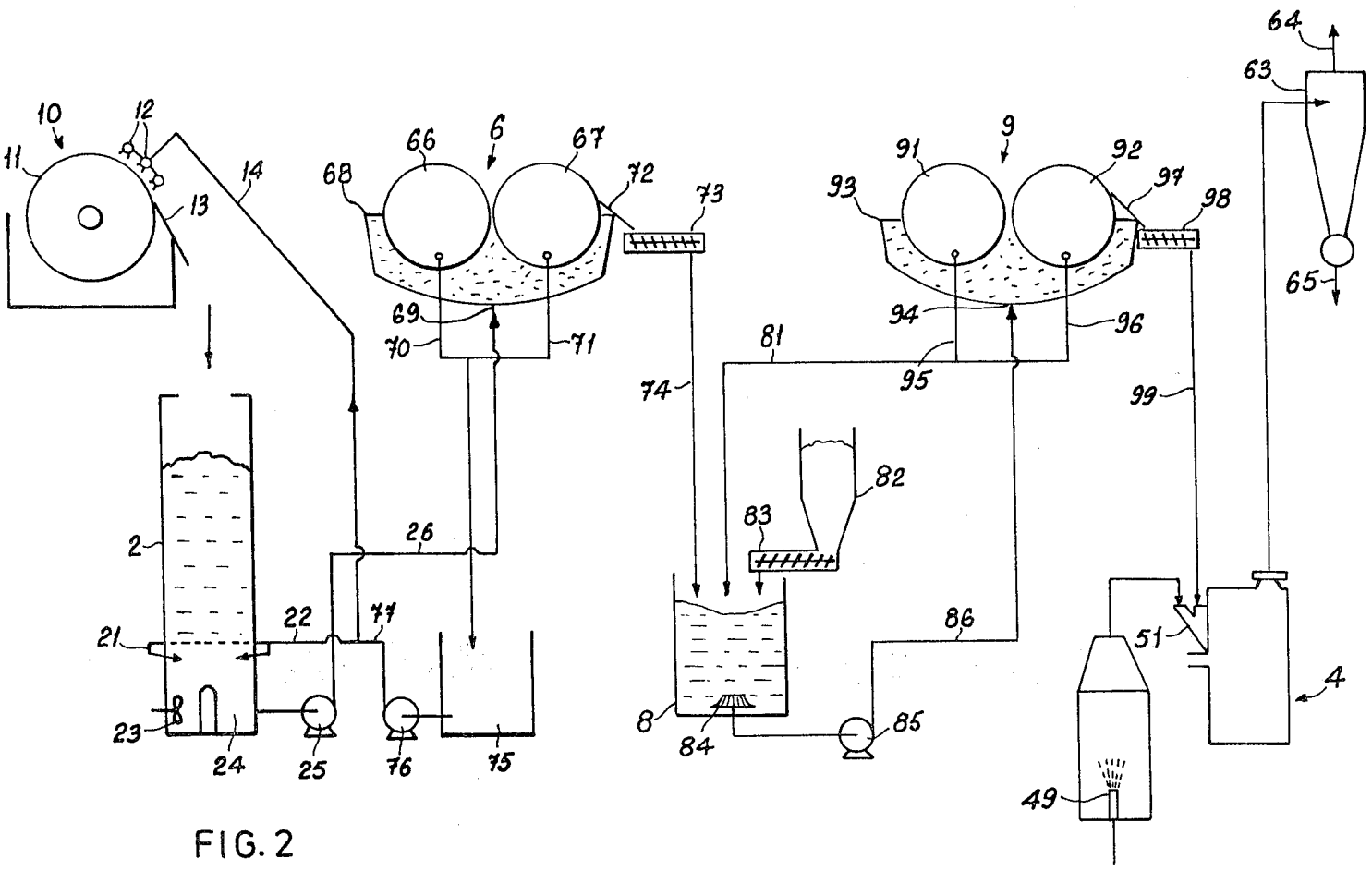
FIG. 2 is a diagrammatic side elevation of an alternative apparatus for drying bleached wood pulp by the process according to the invention.

The apparatus shown in FIG. 2 comprises generally a washer 10 which is the final stage of the bleaching process, a stock tower 2, a first dewatering press 6, a repulper 8, a second dewatering press 9, a drier 4 and a cyclone separator 63. The washer 10, stock tower 2, drier 4 and cyclone separator 63 operate in the same way as in the apparatus of FIG. 1 and are numbered in the same way.

Pulp slurry is pumped from the tower 2 by a pump 25 through a pipe 26 to the first dewatering press 6. This comprises hollow perforated nip rollers 66, 67 rotating in a tank 68 having an inlet 69 for the pulp slurry. Pulp of increased solids content, which has passed the nip, is removed from roller 67 by a doctor blade 72 and passes through a breaker conveyor 73 to a duct 74 which feeds the repulper 8.

The waste water which passes to the interior of the rollers 66, 67 is removed by pipes 70, 71 to a waste water tank 75. Thence it is withdrawn by a pump 76 through a pipe 77 which feeds the pipe 22 leading to the inlets 21 of the stock tower 2 and the pipe 14 leading to the sprays 12 of the washer 10.

The repulper 8 is fed with dewatered pulp by the duct 74, with waste water from the dewatering press 9 by a pipe 81 and with sodium sulphite from a hopper 82 via a meter 83. The repulper 8 has an agitator 84 which disperses the pulp in the water and dissolves the sodium sulphite to maintain the sulphite concentration in the system. Pulp slurry is pumped from the repulper 8 by a pump 85 through a pipe 86 to the second dewatering press 9.

The second press 9 comprises hollow perforated nip rollers 91, 92 rotating in a tank 93 having an inlet 94 for the pulp slurry. Pulp of increased solids which has passed the nip is removed from roller 92 by a doctor blade 97 and passes through a breaker conveyor 98 to a duct 99 which feeds the drier 4. The pulp from the duct 99 contacts hot air from the burner 49 at the inlet chute 51 of the drier 4. The waste water which passes to the interior of the rollers 91, 92 is removed by pipes 95, 96 which feed the pipe 81 leading to the repuler 8.

The apparatus shown in FIG. 2 has a reduced consumption of sodium sulphite compared to that shown in FIG. 1 although it uses more energy in repulping and repressing the pulp.

The invention is illustrated by the following Examples in which percentages are by weight.

Example 1

Bleached Swedish birch pulp was diluted with sodium sulphite solution to provide a slurry containing 4 percent wood pulp solids. The slurry was fed to a dewatering press and a flash drier both of the type shown in FIG. 1. The solids content of the pulp leaving the dewatering press was 49.6 percent. The moisture content of the dry wood pulp discharged by the drier was 8.2 percent and the temperature of the air leaving the drier was 127° C. The initial concentration of sulphite in the water used to slurry the pulp was 1.3 percent. Sulphite solution removed from the pulp in the dewatering press was recycled to slurry further pulp but in this Example no provision was made for adjusting the sulphite concentration of the recycled solution and the sulphite concentration at the end of the trial was 0.6 percent. The concentration of sulphite on the dry pulp produced was 0.1 percent. The suitability of the dry pulp produced for making paper was assessed by determining the amount of work required to remove nodules from the pulp as follows:

A 25 gram sample of dry pulp is placed in a plastic bag and the neck tied. The bag is then placed in a sealed container and incubated in an oven for 24 hours at 80° C. It is then transferred into a T.A.P.P.I. disintegrator (T.A.P.P.I. T205) and 2 liters of water are added. 70 ml samples of slurry are taken from the disintegrator at the following revolutions as shown on the disintegrator counter (the revolutions shown on the disintegrator counter are actual stirrer revolutions divided by 25).

100 revs., 200 revs., 600 revs., 1,000 revs., 1,500 revs. Each sample of slurry is made into hand sheets of paper and for each sample the nodules in the paper are counted and the sheet is weighed. From this the number N of nodules per gram of pulp is determined.

Figure 3:
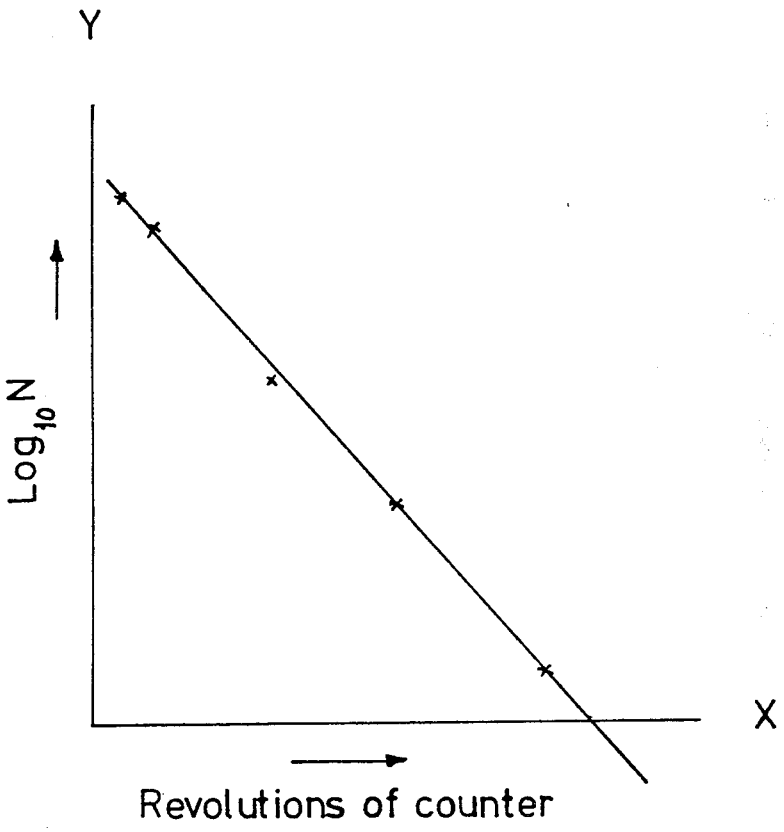
FIG. 3 is a graph of the logarithm of the number of nodules program plotted against revolutions shown on a disintegration counter.

A graph is then completed as shown in FIG. 3 of the accompanying drawings of the logarithm of the number of nodules per gram against revolutions shown on the disintegrator counter. The graph is found to be a substantially straight line as shown in FIG. 3. The point at which the line crosses the X-axis is called "Revolutions To Zero Nodules (RTZN)" and is a measure of the work required to remove nodules from the pulp.

Four samples of the dry pulp produced in this Example were tested by the above procedure and gave RTZN measurements of 1,600, 1,500, 1,100 and 1,350 (mean 1390).

When a similar experiment was carried out on the same bleached birch pulp but without the use of sulphite, RTZN measurements on the dry pulp produced were 2,800, 2,400, 2,000 and 2,300 (mean 2,375).

Example 2

Bleached Swedish birch pulp was diluted with sodium sulphite solution to provide a slurry containing 4.5 percent wood pulp solids. The slurry was fed to a dewatering press and a flash drier both of the type shown in FIG. 1. The solids content of the pulp leaving the dewatering press was 50.0 percent. The moisture content of the wood pulp discharged by the drier was 8.7 percent and the temperature of the air leaving the drier was 120° C. The initial concentration of sulphite in the water used to slurry the pulp was 1.5 percent and the sulphite concentration at the end of the trial was 1.1 percent. The dry pulp produced contained 0.4 percent sulphite.

Four samples of the dry pulp produced in this Example gave RTZN measurements of 700, 1700, 700 and 1000 (mean 1025).

When the same bleached birch pulp was pressed and dried under similar conditions without the use of sulphite, RTZN measurements on the dry pulp produced were 1,900, 3,100, 2,300 and 1,900 (mean 2550).

What is claimed is:

1. A process for producing a dried, bleached, short-fiber hard wood pulp which comprises bleaching at an acid pH a pulp derived from a hardwood, treating said bleached pulp which is at an acid pH due to residual acid remaining in the pulp from the bleaching process with an alkali metal sulphite, and drying said bleached pulp in a flash drier in the presence of said alkali metal sulphite, said alkali metal sulphite being present in an amount sufficient to reduce the formation of nodules of agglomerated wood pulp fibers in the dried pulp.

2. A process according to claim 1, characterised in that the alkali metal sulphite which is added to the pulp is at a concentration of 0.4 to 5 percent by weight in water.

3. A process according to claim 2, characterised in that the bleached pulp is compressed in a dewatering press to increase its solids content to 35 to 60 percent by weight before flash drying and the sulphite is added to the pulp before the solids content of the pulp is increased.

4. A process according to claim 3, characterised in that water is added to the bleached pulp to form it into a slurry for feeding to the dewatering press and the sulphite is added to the bleached pulp with the said water.

5. A process according to claim 2, characterised in that a solution of the alkali metal sulphite is sprayed on the pulp after bleaching.

6. A process according to claim 2, characterised in that the alkali metal sulphite is included in the final washing water used to wash the pulp after bleaching.

7. A process according to claim 1, characterised in that the amount of sulphite on the wood pulp fed to the drier is 0.4 to 5 percent by weight based on wood pulp solids.

8. A process according to claim 1, characterised in that the flash drying step is carried out in a high turbulence mixer through which the pulp and hot gas at a temperature in the range 200° to 600° C. are fed and which has relatively movable mechanical members which exert a shearing action on the pulp.

* * * * *